US007576958B2

(12) United States Patent
Bergh et al.

(10) Patent No.: US 7,576,958 B2
(45) Date of Patent: Aug. 18, 2009

(54) RELAY SOCKET WITH LEAKAGE CURRENT SUPPRESSION

(75) Inventors: Dallas J. Bergh, Waukesha, WI (US); Patrick K. Duffy, Greenfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 979 days.

(21) Appl. No.: 09/967,177

(22) Filed: Sep. 28, 2001

(65) Prior Publication Data

US 2003/0063418 A1 Apr. 3, 2003

(51) Int. Cl.
*H01H 9/00* (2006.01)

(52) U.S. Cl. ..... 361/42; 361/160

(58) Field of Classification Search ..... 361/18, 361/23, 93, 115, 113, 47, 42–45, 160
See application file for complete search history.

(56) References Cited

U.S. PATENT DOCUMENTS 3,633,070 A * 1/1972 Vassos et al. ..... 361/46
3,852,642 A * 12/1974 Engel et al. ..... 361/45
4,159,501 A * 6/1979 White ..... 361/47
5,541,800 A * 7/1996 Misencik ..... 361/45
5,606,480 A * 2/1997 Nevo ..... 361/46
5,859,756 A * 1/1999 Pressman et al. ..... 361/90
5,864,455 A * 1/1999 Gernhardt et al. ..... 361/42
6,025,980 A * 2/2000 Morron et al. ..... 361/42
6,262,871 B1 * 7/2001 Nemir et al. ..... 361/42
6,275,400 B1 * 8/2001 O Breartuin ..... 363/126
6,342,997 B1 * 1/2002 Khadkikar et al. ..... 361/103
6,426,632 B1 * 7/2002 Clunn ..... 324/509
6,522,033 B1 * 2/2003 Nevo ..... 307/125

* cited by examiner

*Primary Examiner*—Danny Nguyen
(74) *Attorney, Agent, or Firm*—Fletcher Yoder LLP; Alexander R. Kuszewski

(57) ABSTRACT

A technique is provided for controlling an operator in a circuit such as a relay circuit. The operator may be a coil in an electromagnetic relay. The coil is energized only when current through a leakage current suppression circuit is sufficient to exceed a predetermined threshold. The leakage current suppression circuit is operative to prevent energization of the operator, or to deenergize the operator, when the current is below the threshold, within a range anticipated for leakage current through the circuit.

14 Claims, 4 Drawing Sheets

RELAY SOCKET WITH LEAKAGE CURRENT SUPPRESSION

BACKGROUND OF THE INVENTION

The present invention relates generally to the control of electrical circuits such as relays. More particularly, the invention relates to a technique for avoiding the ill effects of leakage current in circuits designed to switch on and off coils or other operators for such devices.

Many applications exist for remote switching devices such as relays. In general, such devices typically include one or more contacts which can be opened or closed in response to energization of a coil. Both electromechanical and solid state relays are commonly available. Sizes and ratings of such devices vary widely, depending upon the needs of particular applications, and upon such factors as whether the relays power significant loads or simply provide low-level feedback. Families of relays are currently available which are quite small in physical packaging, and which can be mounted on circuit boards, and other relatively small supports.

A difficulty in application and reliability of certain relays resides in the presence of leakage current in circuitry used to energize the relay coil. In certain relays, particularly in smaller size relays such as those mountable on circuit boards and other small support structures, even low levels of leakage current can cause the relay coil to be energized when such energization is not desired, thereby causing the relay to open or close in an undesirable fashion. Similarly, such leakage current can cause the coil to remain energized a sufficient degree to prevent shifting of the contact or contacts upon removal of a control signal to the coil. In either case, the reliability of the relay and the signals produced by the relay is jeopardized by the leakage current.

There is a need, therefore, for an improved technique for controlling relays and similar circuits. There is a particular need for circuitry which can more reliably switch on and off a relay coil. There is, at present, a need for relatively straightforward and simple circuitry which can suppress leakage current in relay circuits so as to improve their reliability.

SUMMARY OF THE INVENTION

The present invention provides a control circuit for relays and similar devices designed to respond to such needs. The circuitry is particularly well-suited to controlling energization current to a coil, such as a relay coil. The circuit effectively suppresses leakage current at levels which could cause false energization or prevent deenergization of the relay coil in operation. The technique is particularly well-suited to small relay circuits, such as those used in circuit board-mountable or similar relays. Moreover, the technique may be used for circuits in which control signals are applied in either alternating current or direct current form. The circuitry can be adapted for a range of voltage ratings, with the present embodiments being provided for at least two different voltage ratings.

The technique makes use of signal conditioning circuitry for incoming control signals, such as to convert incoming alternating current signals to direct current signals. Other signal conditioning circuitry is used to smooth direct current waveforms in a direct current bus. Other signal conditioning circuitry serves to limit the voltage across the bus. A solid state switch is employed to regulate current through the controlled device, a relay coil in a present embodiment. The coil is placed in series with the solid state switch. A leakage current suppression circuit is placed in parallel with the solid state switch, and is used to switch on and off the solid state switch, permitting current through the coil, only if the applied control signals exceed a leakage current threshold.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
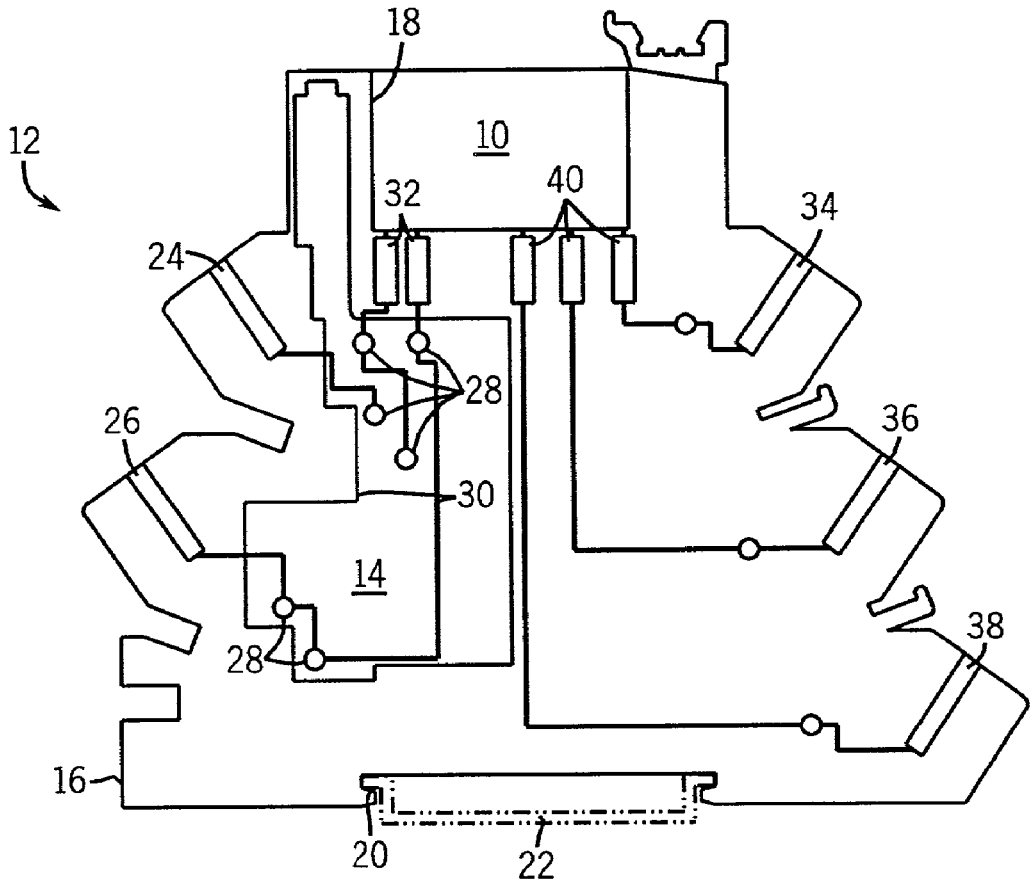
FIG. 1 is a diagrammatical representation of a terminal block incorporating circuitry for suppressing leakage current in a relay control circuit in accordance with aspects of the present technique.

Turning now to the drawings, and referring first to FIG. 1, a relay 10 is illustrated in an exemplary embodiment as being supported on a terminal block 12. Relay 10 is designed to be received on the terminal block and to receive control signals, and to produce output signals as summarized more fully below. The terminal block 12 supports a circuit board 14 which is designed to power the relay and to carryout control functions in accordance with aspects of the present technique. In the diagrammatical representation of FIG. 1, terminal block 12 is illustrated as including a housing 16 in which the circuit board is mounted. In practice, the circuit board may be covered with a mating housing section, where desired. A bay or recess 18 is provided in an upper section of the terminal block 12 for receiving the relay 10. In the illustrated embodiment, the terminal block 12 is designed to be mounted via a mounting interface 20 at its lower extremity. The mounting interface 20 in the illustrated embodiment interfaces with a DIN rail 22 of conventional design.

In the implementation of FIG. 1, the terminal block 12 provides connection points or terminals for control inputs for regulating energization of a coil within relay 10, and for outputting signals from the relay in response to the control input. For example, in the diagrammatical representation of FIG. 1, line inputs 24 and 26, one of which will typically be a neutral input, are provided on a first side of the terminal block housing. The line inputs 24 and 26 are electrically connected to conductive pads 28 on the circuit board 14. Traces 30 extend on the circuit board and permit interconnection of the line inputs with the relay 10. In particular, traces 30 route electrical current between pads of the circuit board, with upper pads being linked to coil contacts 32. Contacts 32 are designed to route electrical control signals to relay 10 for energizing the relay coil as described below.

In addition to line inputs 24 and 26, terminal block 12 presents output terminals 34, 36 and 38. The output terminals are designed to provide output signals to downstream circuitry based upon the conductive state of relay 10. The output terminals 34, 36 and 38 are linked to respective contacts 40 which are electrically coupled to relay 10 when inserted in the terminal block housing. As will be appreciated by those skilled in the art, output terminals 34, 36 and 38 will typically provide for common, normally-open and normally-closed wiring.

Relay 10 operates in a conventional manner when control signals are applied to it via line inputs 24 and 26 and circuit board 14. That is, when electrical current is applied to the relay coil, contacts within the relay are closed to provide an output signal at contacts 40 and thereby at output terminals 34, 36 and 38. The present technique provides for suppression of leakage current via circuitry populated on board 14.

While in the present discussion, reference is made to a terminal block-mounted relay 10, it should be understood that the present technique may be applied to a wide range of circuits and devices, including relays mounted other than on a terminal block. Accordingly, the technique may be applied to circuit board-mountable relays, one or multiple pole relays, as well as relays and other devices having substantially different packaging. In general, the technique provides for suppression of leakage current which could otherwise cause false energization or which could prevent deenergization of a coil or other operator provided in the relay. It should also be noted, that in addition to conventional electromechanical relays, the present technique may be equally well employed for solid state relays.

Figure 2:
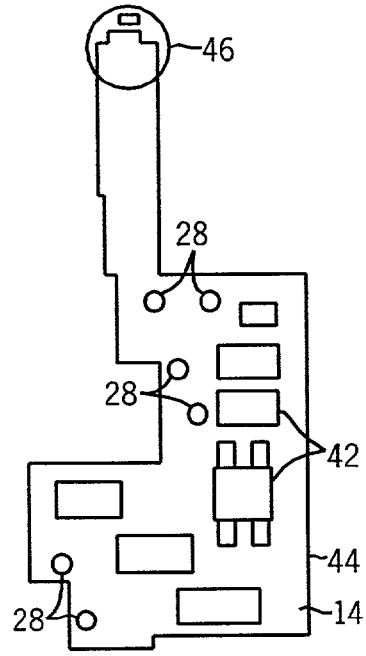
FIG. 2 is an exemplary elevational view of a printed circuit board on which a circuit in accordance with the present technique may be mounted in a terminal block such as that illustrated in FIG. 1.

FIG. 2 illustrates an exemplary circuit board configuration on which the circuitry described below may be supported. In the embodiment illustrated in FIG. 2, a circuit board 14 is contoured so as to fit within a portion of a terminal block housing of the type illustrated in FIG. 1. Circuit components 42 are mounted on one or more surfaces of the circuit board 14, and interconnected as described below. Contact pads 28 are provided for interfacing the circuit board with external circuitry, including input terminals and output contacts leading to the downstream circuitry, such as the circuitry within a relay 10 (see FIG. 1). A periphery 44 of the circuit board provides a convenient interface for engagement of the circuit board within a support housing. However, other alternative mounting structures and schemes may be envisaged. In a present embodiment, an extremity of the circuit board supports an LED 46 which provides a visual indication of the conductive state of the circuitry described below. The LED may be made visible at a convenient side or edge surface of the support device, such as along an upper edge of the terminal block illustrated in FIG. 1.

Figure 3:
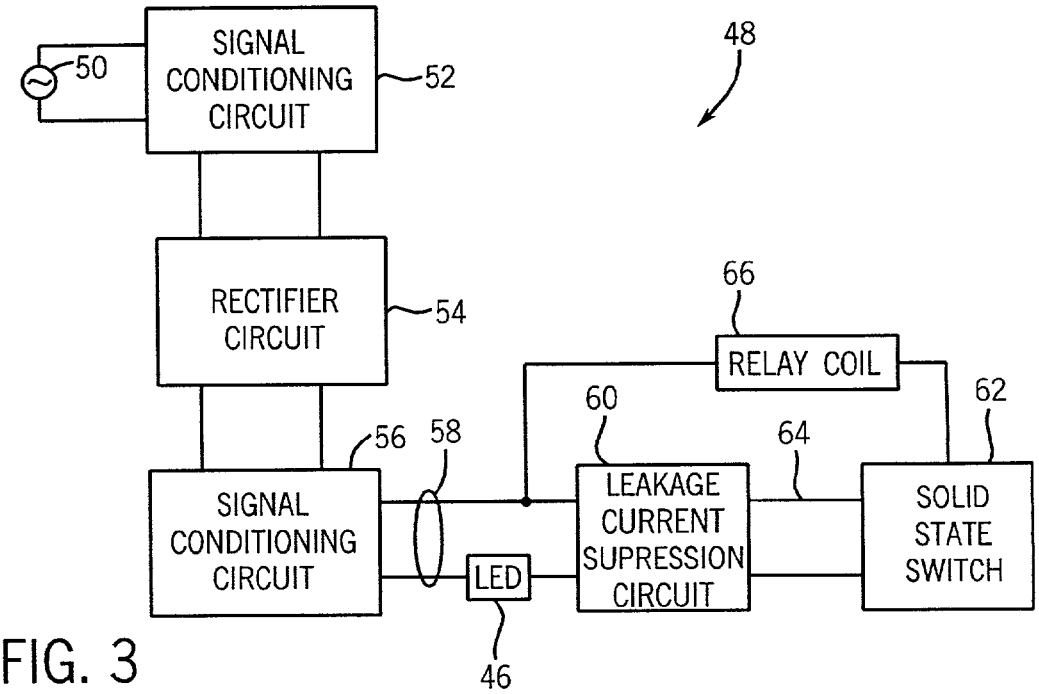
FIG. 3 is a functional block diagram of a control circuit for regulating and suppressing leakage current in accordance with aspects of the present technique.

Certain of the functional circuitry included in an exemplary embodiment of the present technique is shown in FIG. 3. The control circuitry, designated generally by the reference numeral 48, serves both to condition input signals and to regulate application of current to the downstream device, in the illustrated example a relay coil. Thus, the control circuit 48 includes a control signal source 50, which may be either an alternating current source or a direct current source. Moreover, various voltage and current ratings may be provided in the device, as illustrated and described in greater detail below with reference to FIGS. 4 and 5. A signal conditioning circuit 52 appropriately regulates the incoming control signal for application to a rectifier circuit 54. Circuit 54 serves to rectify alternating current control signals to produce direct current waveforms. While the rectifier circuit 54 is unnecessary in applications where a direct current input control signal is available, the circuit may be included in all implementations, where desired, to provide for application of either alternating current or direct current input signals.

A signal conditioning circuit 56 is provided along a DC bus 58 downstream of the rectifier circuit 54. The signal conditioning circuit 56 serves to improve the direct current bus voltage and to limit the voltage to a desired range. LED 46 is provided in series with the signal conditioning circuit 56 on one side of the DC bus to provide an indication of the operative state of the device (i.e., powered or unpowered).

A leakage current suppression circuit 60 is provided along the DC bus 58 to suppress leakage current which may otherwise be present along the DC bus. The leakage current suppression circuit is linked to a solid state switch 62, providing a control input 64 to the solid state switch as described more fully below. The relay coil is positioned in series between the DC bus and the solid state switch 62. Thus, in operation, the leakage current suppression circuit 60 prevents application of current to the relay coil 66 by regulating the conductive state of solid state switch 62. As described more fully below, when current applied along the DC bus exceeds a predetermined leakage current threshold value, leakage current suppression circuit 60 causes solid state switch 62 to conduct, thereby allowing application of current through relay coil 66. If the current level is below the leakage current threshold level, all current through relay coil 66 is prevented by solid state switch 62, again under the control of leakage current suppression circuit 60.

Figure 4:
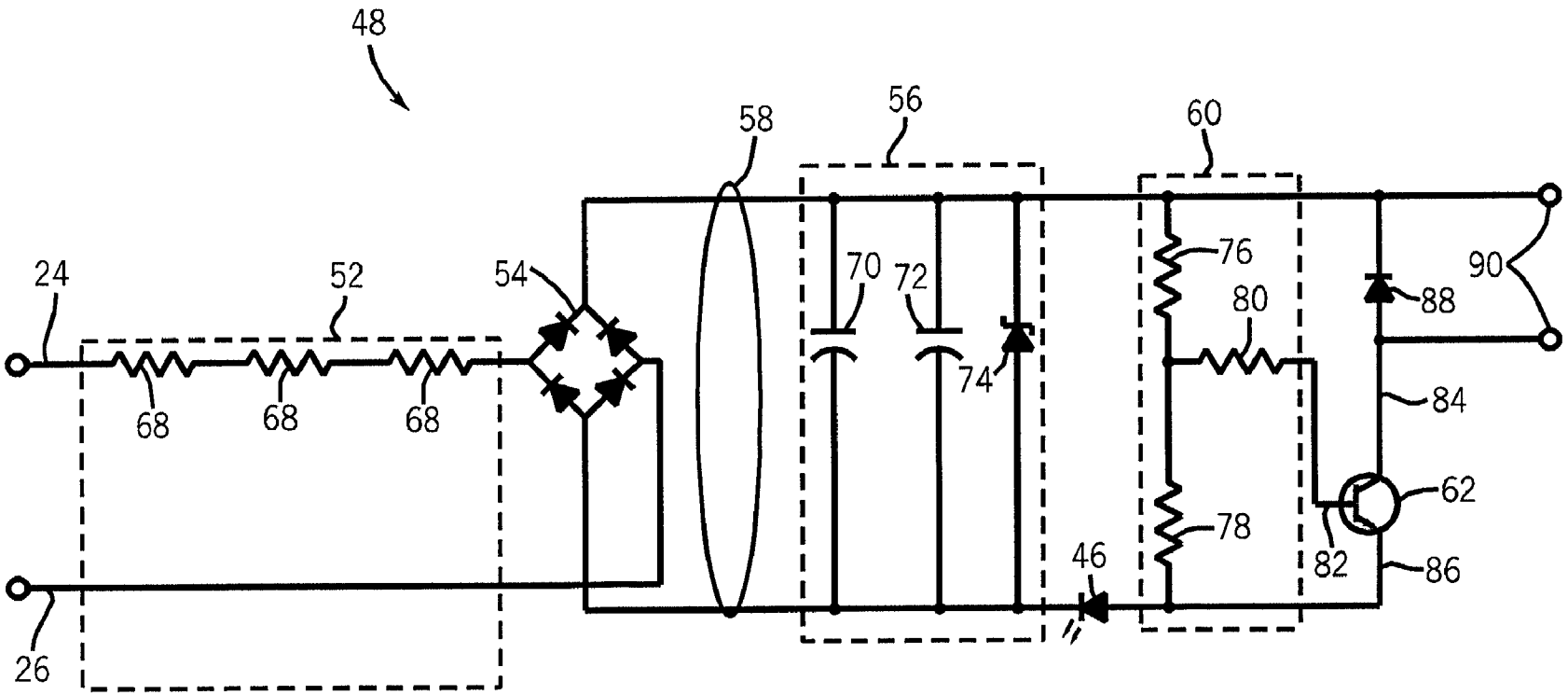
FIG. 4 is a circuit diagram of an exemplary control circuit in accordance with the present technique.
Figure 5:
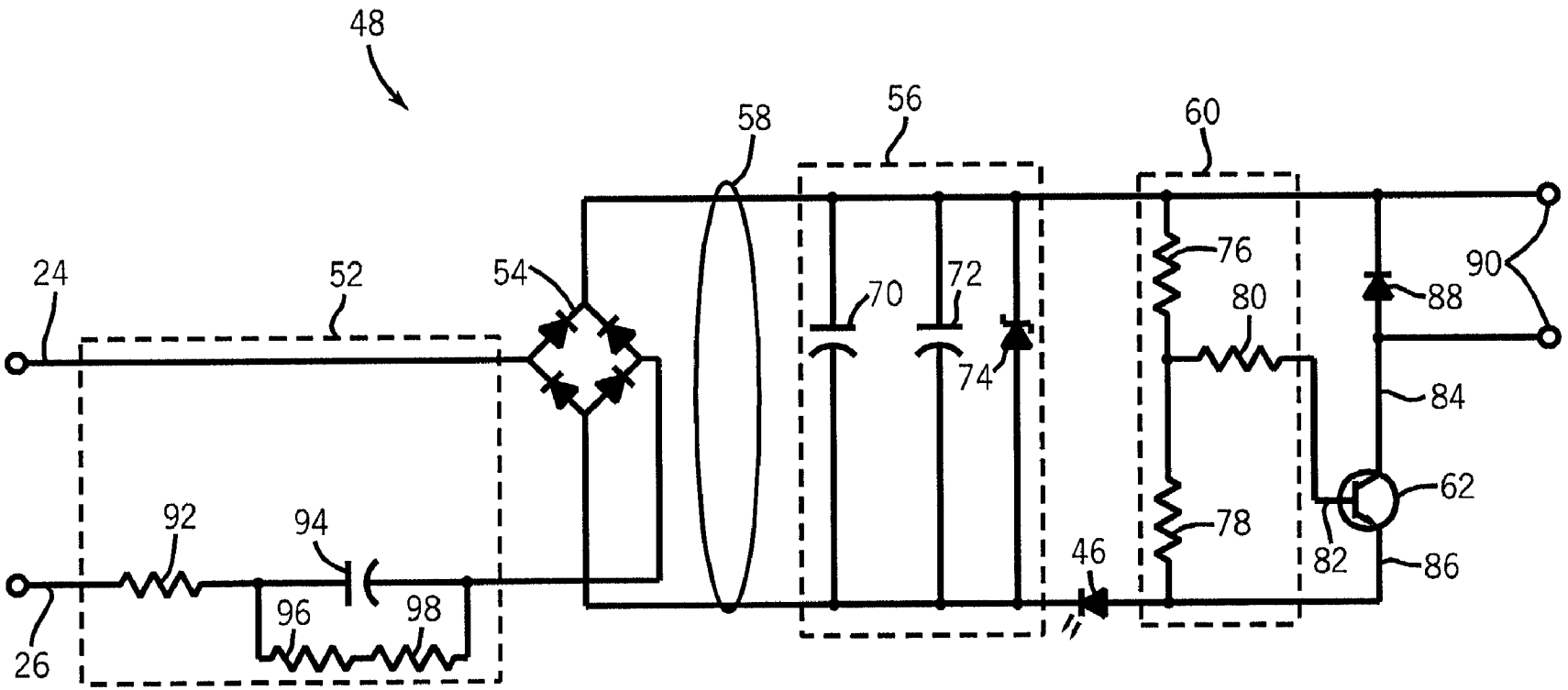
FIG. 5 is a circuit diagram for a second exemplary embodiment of a control circuit in accordance with the present technique.

FIGS. 4 and 5 illustrate exemplary implementations of the functional circuitry illustrated in FIG. 3. Referring first to FIG. 4, control circuit 48 receives input control signals via lines 24 and 26. In the circuit configuration of FIG. 4, either alternating current or direct current input control signals may be applied. A signal conditioning circuit 52 includes a series of resistors 68 which limit current through the circuit. The configuration of FIG. 4 is particularly adapted to a voltage rating of 120V, and to either AC or DC input signals, although other configurations and ratings can be envisaged. The input control signals are applied to rectifier circuit 54. As will be appreciated by those skilled in the art, the rectifier circuit will rectify AC input control signals, and pass DC input control signals unaltered. The input control signals are then routed to DC bus 58, across which signal conditioning circuit 56 is coupled.

In the embodiment of FIG. 4, circuit 56 includes a pair of capacitors 70 and 72 which smooth ripple in the voltage across the DC bus where the input control signal is applied in an AC waveform. In a present embodiment, both capacitors have a rating of 0.22 μF. Circuit 56 further includes a Zener diode 74 which limits or clamps the voltage across the bus to a desired level. In a present embodiment, Zener diode 74 clamps the DC bus voltage to a maximum of 62 volts. Other ratings and voltage levels may, of course, be employed, depending upon the particular circuitry used with the DC bus and the rating of the relay coil or operator.

Leakage current suppression circuit 60 is coupled across the DC bus in parallel with the solid state switch 62. In the illustrated embodiment, circuit 60 includes a pair of resistors 76 and 78 joined by a central node. Resistors 76 and 78 dissipate current, and are selected to provide sufficient voltage at the common node point to place solid state switch 62 in a conductive state only when current through the resistors exceeds a predetermined leakage current threshold level. In a present embodiment, resistor 76 has a rating of 15 kΩ, while resistor 78 has a rating of 464 Ω. A third resistor 80 is coupled to the common node point, and serves to limit current to the base of solid state switch 62 as described more fully below. In a present embodiment, resistor 80 has a rating of 2.43 kΩ.

Solid state switch 62 is coupled in parallel with the leakage current suppression circuit 60, and is configured to be coupled in series with the operator of the relay or other powered circuit as described above. In the present embodiment, switch 62 is a bipolar NPN transistor. The base 82 of switch 62 is coupled to resistor 80 of the leakage current suppression circuit. The collector 84 is coupled to circuit 60 as described below. The emitter 86 is coupled to the low side of the DC bus 58. In the illustrated embodiment, a flyback diode 88 is provided to clamp any voltage spike that may result from deenergization of the relay coil. Finally, terminals 90 are provided for coupling the relay coil to the circuit. In the embodiment described above, terminals 90 lead to contacts 32 (see FIG. 1) for coupling to the relay.

In operation, AC or DC input control signals are applied to terminals 24 and 26 of circuit 48. The voltage levels of the input control signals are reduced by resistors 68, and, where the input control signal is an AC waveform, the waveform is rectified by circuit 54. The resulting DC control signal is applied to DC bus 58, and ripples are removed by capacitors 70 and 72, while the voltage across the DC bus is clamped by Zener diode 74. The operative state of the control signal is visually indicated by LED 46.

When the level of signals across the DC bus is such that leakage current below a desired threshold occurs through resistors 76 and 78, the voltage at the common node will be insufficient to place switch 62 in a conductive state, thereby preventing any current through the relay operator coupled to terminals 90. In a current implementation, the components are selected to require a current of at least two mA through resistors 76 and 78 before placing switch 62 in a conductive state. Other threshold levels may, of course, be employed. When a control signal is applied to the circuit, raising the voltage level across the DC bus, current through resistors 76 and 78 will increase above the threshold level, causing a rise in the voltage level at the common node point to a level above the leakage current threshold, and thereby at base 82 of switch 62. The switch is then placed in a conductive state, and the circuit is completed through the relay operator coupled to terminals 90.

An alternative configuration for circuit 48 is illustrated in FIG. 5. As noted above, a wide variety of voltage and current ratings may be provided within the scope of the present technique. The circuit of FIG. 5 is particularly well-suited to higher input control signal ratings, such as 240 VAC. To accommodate such signals, the signal conditioning circuit 52 includes a resistor 92 in series with a capacitor 94. A pair of resistors 96 and 98 are provided electrically and parallel with capacitor 94. The capacitor serves essentially as a series resistance for dropping the line voltage of the input control signal while avoiding heating. Resistors 96 and 98 serve to provide a discharge means for capacitor 94 following removal of control signals from terminals 24 and 26. Resistor 92 serves to limit current through capacitor 94 during initial application of control signals to terminals 24 and 26. In a current implementation, resistor 92 has a rating of 1.5 kΩ, while resistors 96 and 98 have a rating of 475 kΩ. Capacitor 94 in a present implementation has a rating of 0.15 μF. The remainder of the circuit illustrated in FIG. 5 is identical to the circuitry of FIG. 4 both in structure and function.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A relay control circuit comprising:

a relay having an operator and at least two output lines;

a solid state switch coupled in series with the relay operator to control energization of the relay operator; and a leakage current suppression circuit coupled electrically in parallel with the solid state switch, the leakage current suppression circuit being operative to conduct leakage current leaking into the control circuit and to place the switch in a conducting state and thereby to energize the relay operator when a control signal current level is above an input leakage current threshold, and to place the switch in a non-conducting state and thereby to deenergize the relay operator when the control signal level is below the input leakage current threshold.

2. The circuit of claim 1, wherein the relay is an electromechanical relay and the operator is a coil.

3. The circuit of claim 1, wherein the terminal block includes connections for routing the output lines to terminal points.

4. The circuit of claim 1, further comprising a rectifier circuit for converting alternating current control signals to direct current control signals.

5. The circuit of claim 4, further comprising a signal conditioning circuit for smoothing the direct current control signals.

6. The circuit of claim 4, further comprising a signal conditioning circuit for limiting the voltage of the direct current control signals to a desired level.

7. The circuit of claim 1, further comprising a visual indicator of the operative state of the circuit.

8. The circuit of claim 1, wherein the leakage current suppression circuit includes a pair of resistors in series about a node, and wherein the leakage current suppression circuit is operative to place the solid state switch in a conducting state when a voltage at the node is above a desired level.

9. The circuit of claim 8, wherein the node is coupled to a base of the solid-state switch.

10. A terminal block relay assembly comprising:

a terminal block including input terminals, output terminals, a bay for receiving a relay, and connections for routing signals between the terminals and the relay;

a relay disposed in the bay and coupled to the connections, the relay having an operator;

a circuit board supported in the terminal block and coupled to the input terminals and to the relay operator via two of the connections;

a solid state switch supported on the circuit board and coupled in series with the relay operator to control energization of the relay operator; and a leakage current suppression circuit supported on the circuit board and coupled electrically in parallel with the solid state switch, the leakage current suppression circuit being operative to conduct leakage current leaking into the terminal block relay assembly and to place the switch in a conducting state and thereby to energize the relay operator when a control signal current level is above an input leakage current threshold, and to place the switch in a non-conducting state and thereby to deenergize the relay operator when the control signal level is below the input leakage current threshold.

11. The circuit of claim 10, wherein the relay is an electromechanical relay and the operator is a coil.

12. The circuit of claim 10, further comprising a light emitting diode coupled to be energized upon application of the control signal, the light emitting diode producing a visual indication of the operative state of the control signal visible from a side of the terminal block.

13. The circuit of claim 10, wherein the leakage current suppression circuit includes a pair of resistors in series about a node, and wherein the leakage current suppression circuit is operative to place the solid state switch in a conducting state when a voltage at the node is above a desired level.

14. The circuit of claim 13, wherein the node is coupled to a base of the solid-state switch.

* * * * *

UNITED STATES PATENT AND TRADEMARK OFFICE

CERTIFICATE OF CORRECTION

PATENT NO. : 7,576,958 B2
APPLICATION NO. : 09/967177
DATED : August 18, 2009
INVENTOR(S) : Bergh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 735 days.

Signed and Sealed this

Seventh Day of September, 2010

David J. Kappos

David J. Kappos
*Director of the United States Patent and Trademark Office*